United States Patent [19]

Ferloni

[11] Patent Number: 4,992,016

[45] Date of Patent: Feb. 12, 1991

[54] DEVICE FOR CHARGING AND DISCHARGING YARN CHEESES FROM CHEESE FRAMES

[75] Inventor: Alessandro Ferloni, Gerenzano, Italy

[73] Assignee: Camel Robot S.p.A., Milan, Italy

[21] Appl. No.: 262,737

[22] Filed: Oct. 12, 1988

[30] Foreign Application Priority Data

Oct. 12, 1987 [IT] Italy ..... 22226 A/87

[51] Int. Cl.[5] ..... B65G 60/00

[52] U.S. Cl. ..... 414/27; 414/789.9; 414/790.2; 414/795.4; 414/795.7; 414/798; 414/910; 414/911; 414/753; 68/210

[58] Field of Search ..... 414/27, 684, 749, 751, 414/729, 753, 789.9, 790.2, 790.6, 795.9, 795.4, 795.7, 796.9, 797.8, 798, 798.1, 910, 911, 744.1, 744.3; 901/7, 16; 68/210; 294/94, 95, 97; 242/35.5 A

[56] References Cited

U.S. PATENT DOCUMENTS

| | | | |
|---|---|---|---|
| 3,946,884 | 3/1976 | Kato et al. | 414/27 X |
| 4,504,186 | 3/1985 | Richards | 414/792.9 X |
| 4,830,568 | 5/1989 | Maccaferri | 414/910 X |

FOREIGN PATENT DOCUMENTS

| | | | |
|---|---|---|---|
| 0209652 | 1/1987 | European Pat. Off. | 414/911 |
| 2300838 | 7/1974 | Fed. Rep. of Germany | 68/210 |
| 3343957 | 6/1985 | Fed. Rep. of Germany | 414/911 |
| 0599383 | 5/1978 | Switzerland | 414/27 |

*Primary Examiner*—Joseph J. Rolla
*Assistant Examiner*—Boris Milef
*Attorney, Agent, or Firm*—Wenderoth, Lind & Ponack

[57] ABSTRACT

An apparatus for charging and discharging yarn cheeses from cheese frames. A frame has a locking rod extending downwardly therefrom. The frame also supports a vertically traversing carriage. The carriage mounts a pair of gripping arms which extend downwardly therefrom and which are disposed about, and rotatable about, the locking rod. The free end of the locking rod may be expanded to hold yarn cheeses thereon, and the free ends of the gripping arms have grippers to raise or lower a yarn cheese onto or off of the locking rod. Rotation of the arms allows them to be placed within spaces adjacent closely packed yarn cheeses. The entire frame is movable in two directions to properly place the locking rod.

10 Claims, 7 Drawing Sheets

DEVICE FOR CHARGING AND DISCHARGING YARN CHEESES FROM CHEESE FRAMES

BACKGROUND OF THE INVENTION

1. Field of the invention

This invention generally relates to yarn dyeing machines, and, more particularly, to a device for charging and discharging yarn cheeses from cheese frames.

2. Description of the prior art

As is known, for dyeing yarns, cheeses on which yarns are wound are used and these cheeses are arranged at a cheese frame which has on its center a support post and a number of hollow columns having radial holes, on which the cheeses are threaded and stacked so as to form cheese stacks. When the cheese frame is filled, it is lifted and inserted in the dye liquor container where the yarn is dyed by flowing the dye liquor through the column holes and the holes which the inner wall of the cheeses are provided with, from the outside to the inside and viceversa.

The charging and discharging operations of the cheeses on the cheese frames are carried out by hand or by means of devices provided with three arms angularly spaced by 120°, which place the cheeses on the columns and then the cheeses stacks in rows. However, since the cheese frame is normally circular in shape, a row arrangement of the cheese does not give the possibility of best utilizing the cheese frame surface, resulting in a dye liquor waste.

Therefore, the present trend is to provide cheese frames which can utilise the greatest portion of their surface. In order to attain this object, the cheese stacks are arranged in concentric circles and the cheeses of each circle are offset to those of the adjacent internal or external circle. By means of a cheese frame of this kind, the cheeses are nearly in contact to each other and the void spaces among the cheeses are practically reduced to a minimum. In the known devices, therefore, the cheese charging and discharging operations cannot be carried out because the above mentioned charging and discharging elements can no longer accurately enter the spaces among the cheese stacks, since these spaces are circumferentially spaced in an irregular manner charging and discharging yarn cheeses from cheese frames of dyeing machines, yarn cheeses, which overcomes the above mentioned drawbacks and which lends itself to charge and discharge the cheeses in a fully automatic manner without intervention of labour.

SUMMARY OF THE INVENTION

More particularly, the device for charging and discharging yarn cheeses from cheese frames according to the present invention comprises a pair of arms provided on their lower ends with gripping means and vertically movable together and swingable with respect to each other and a fixed center guide rod located between the pair of arms. The rod has at its lower end gripping means, so that the center guide rod can be placed on the extension of the cheese frame column intended to be charged or discharged and so act as a guide for the cheeses which are lifted by the gripping means of the arms engaging the cheese for lifting or lowering it, whereas the gripping means of the center guide rod are intended to lock the cheese already threaded thereon, thereby preventing the cheese from falling down when the arms are again moved for gripping the next cheese, the device being further provided with means for moving it vertically and horizontally in order to position it above the column intended to be charged and discharged.

DESCRIPTION OF THE PREFERRED EMBODIMENT

Figure 1:
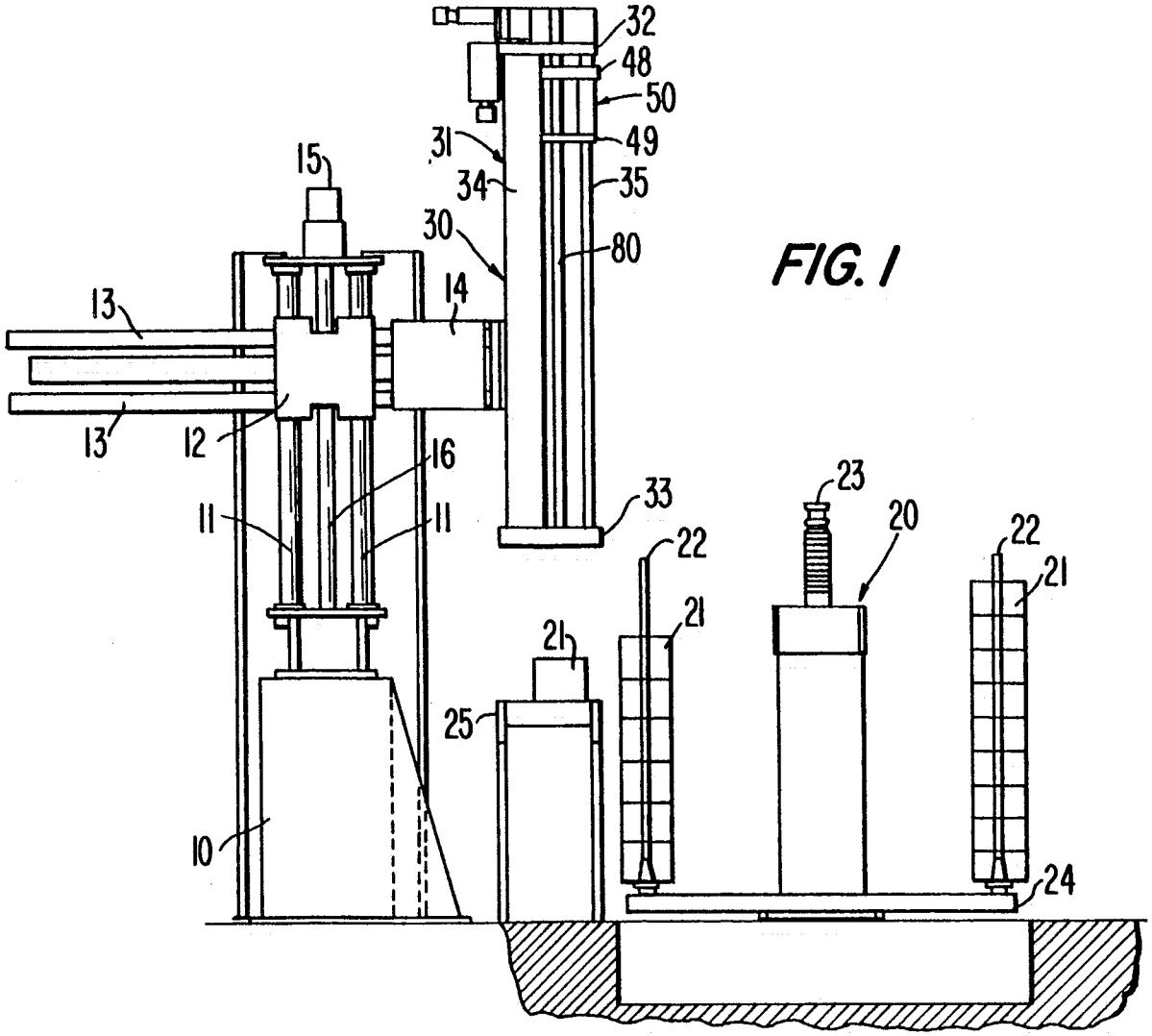
FIG. 1 is a side elevation view of the system in accordance with the present invention.
Figure 2:
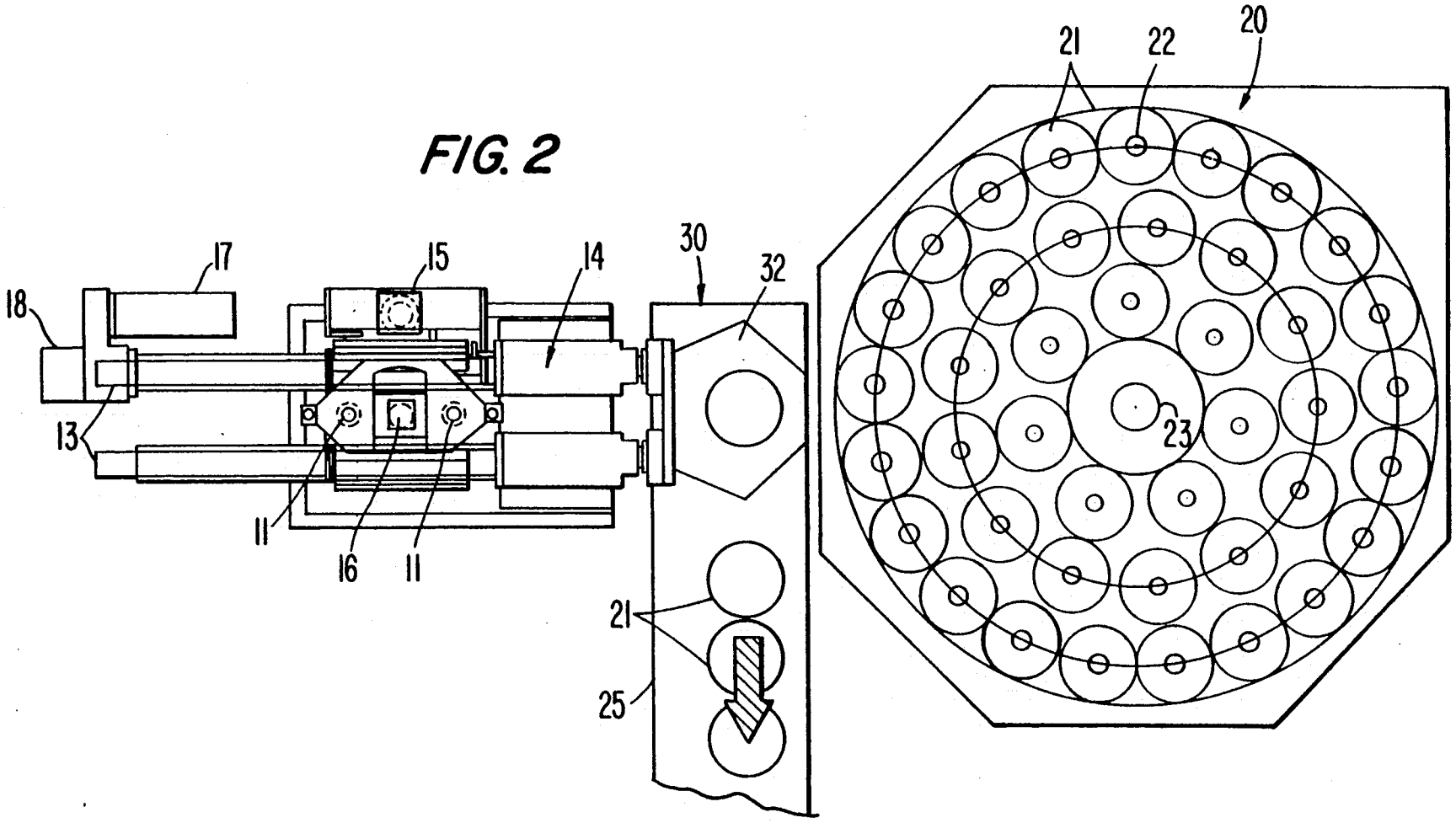
FIG. 2 is a top plan view of the system of FIG. 1.

Referring now to FIGS. 1 and 2, the system for charging on and discharging from cheese frames yarn cheeses comprises a base 10 provided at an upper portion with a pair of guide columns 11 supporting a carriage 12 which can slide in a vertical direction and in which a second carriage 14 which can slide in a horizontal direction on guides 13 is arranged. Second carriage 14 carries at one end thereof the device for charging and discharging yarn cheeses according to the present invention, generally designated at 30. The vertical movement of the carriage 12 is imparted by a motor 15 which rotates a screw 16, whereas the horizontal movement of the carriage 14 is imparted by a motor 17 through a reduction gear 18. In this manner the device can be moved in a horizontal and a vertical direction. In the range of action of the device 30 a cheese frame 20 is arranged, which is intended to receive yarn cheeses 21 on a number of columns 22 arranged on concentric circles of decreasing diameter (see FIG. 2). Located at the center of the cheese frame 20 is the conventional post 23 intended to lift, and lower and transport the cheese frame. Disposed below the cheese frame 20 is a rotatable platform 24 allowing the cheese frame to be rotated in both the rotational directions.

Disposed below the device 30 is a conveyor belt 25 intended to feed the yarn cheeses 21 to the device 30 or to discharge them therefrom.

With the arrangement of the cheeses on the columns and with the arrangement of the columns on concentric circles having a decreasing diameter from the outside, the maximum utilisation of the supporting surface of cheese frame 20 is obtained.

The cheese charging and discharging device proper, designated with 30, is intended to pick-up the cheeses from the conveyor belt 25 and to transport them to the various columns 22 so as to form the cheese stacks or viceversa to pick-up the cheese stacks from the columns 22 and to transport them to the conveyor belt 25.

In order to accomplish this, the device 30 is movable, as already said, in a horizontal direction covering all the cheese frame 20 and in a vertical direction. With the horizontal movement of the device 30 combined with the rotary movement of the cheese frame 20 all the columns in the cheese frame can be filled with cheeses.

The cheese charging and discharging device 30 comprises a frame, generally designated with 31, including an upper plate 32, a lower plate 33 and a connecting wall 34 (FIG. 1). Extending between the upper plate 32 and the lower plate 33 is a pair of a guide bars 35, 35', a pair of screws 36, 36' and a pair of fluted shafts 37, 37', all of which are rotatably connected to end plates 32, 33 by means per se known (FIGS. 6 and 7).

Figure 3:
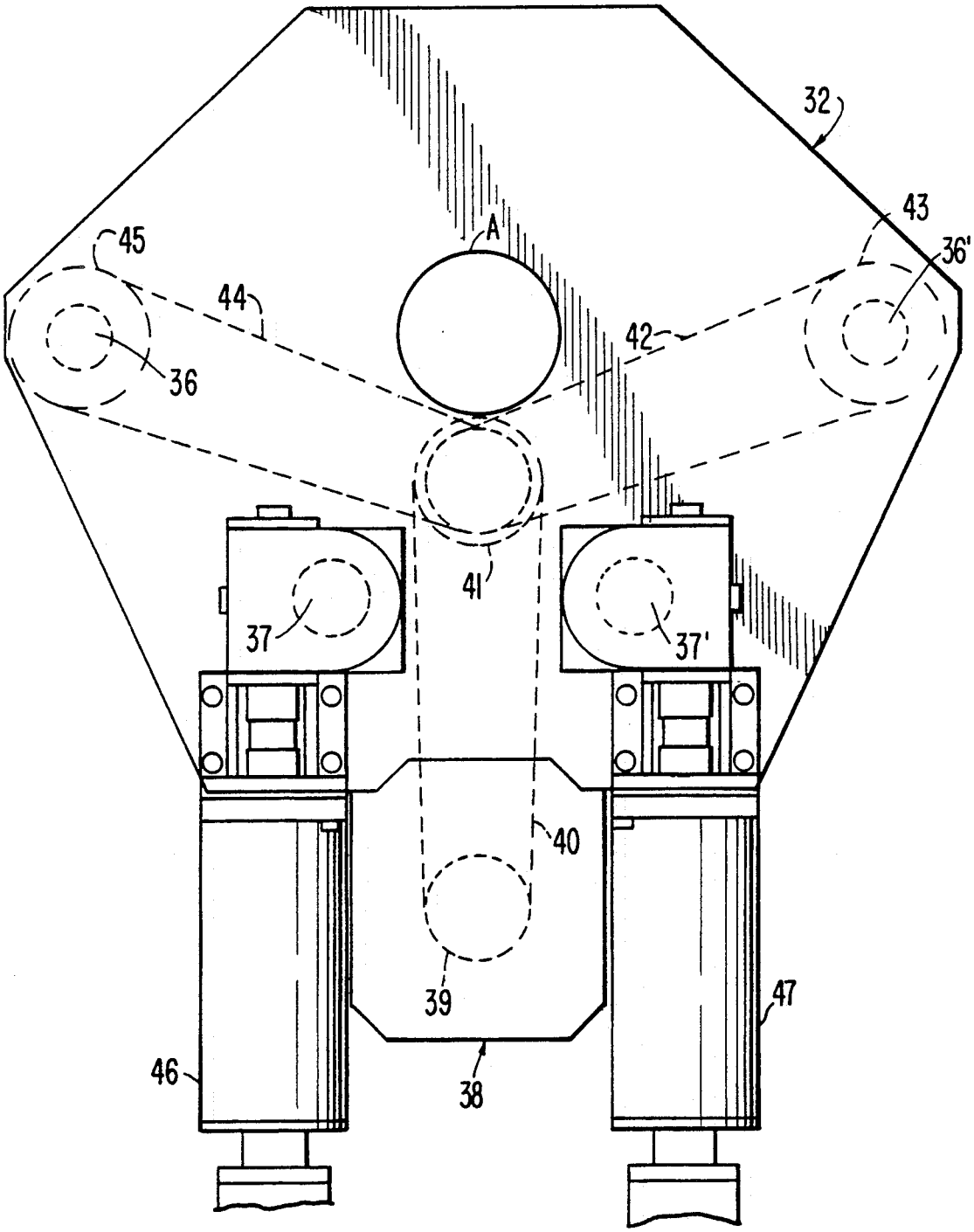
FIG. 3 is a top plan view of the upper fixed plate of the device of the present invention.

As can be seen from FIG. 3, the fluted shafts 37, 37' and the screws 36 and 36' are driven by electric motors placed on the upper plate 32. The motor 38 actuates the screws 36,36' through belt drives. A pulley 39 driven by the output shaft of motor 38 rotates, through a belt 40, the intermediate pulley 41 of a group of three coaxial pulleys, of which the lower one actuates, through a belt 42, a pulley 43 fastened to the screw 36' and the upper one actuates, through the belt 44, a pulley 45 fastened to the screw 36. A motor 46 rotates, through a worm gear, the fluted shaft 37 and a motor 47 actuates, through a worm gear, the fluted shaft 37'. In the upper plate 32 a bore A is provided which slidably receives a center guide rod 90 (FIG. 7) of the device 30 and which will be described later.

Figure 5:
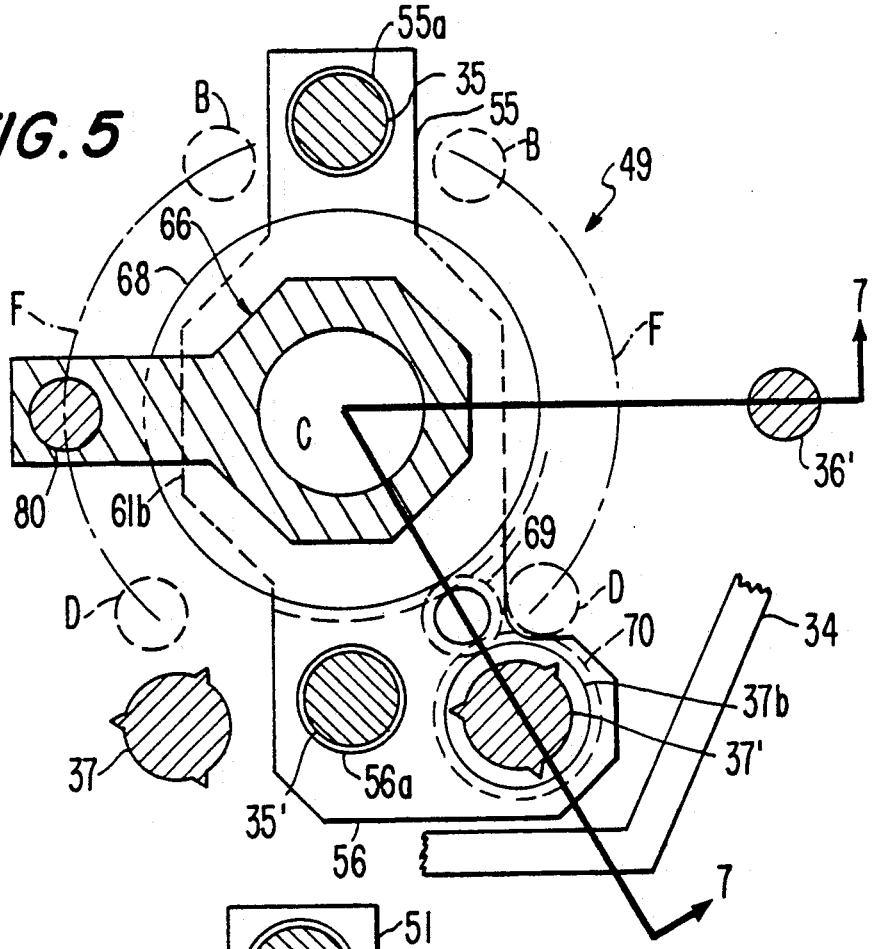
FIGS. 5 and 6 are cross-sectional views of the lower and upper plates forming the sliding carriage of the device.
Figure 6:
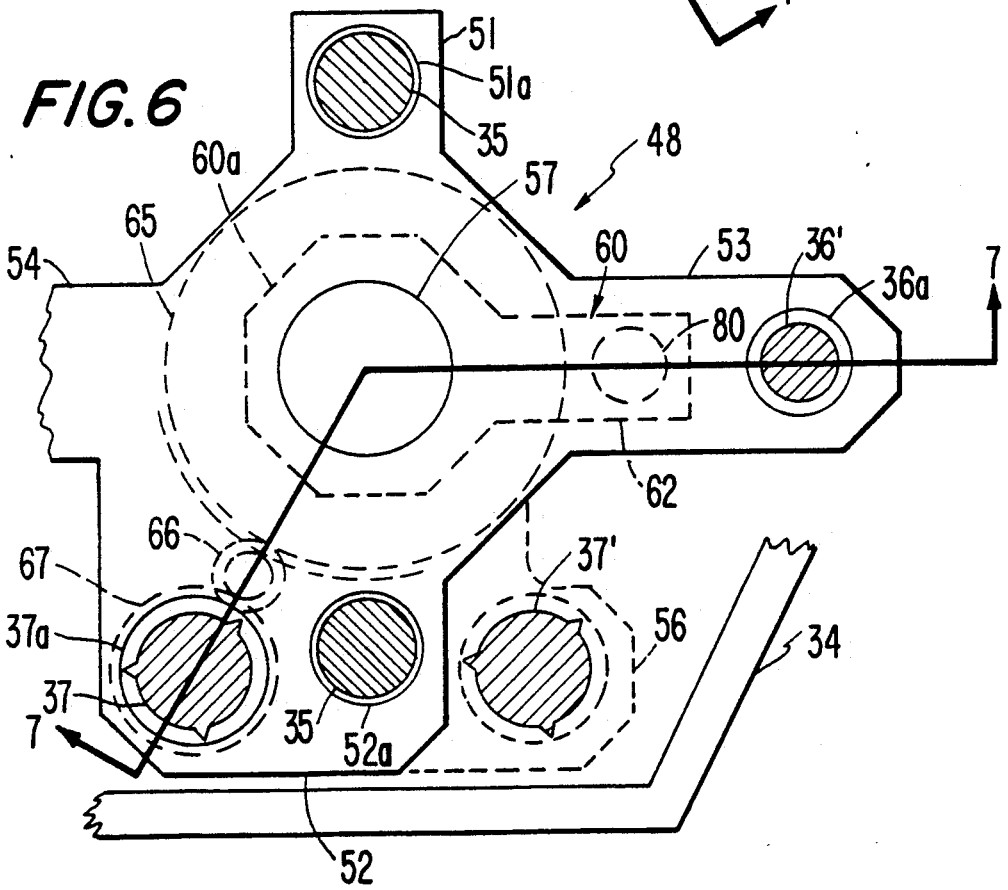
Figure 7:
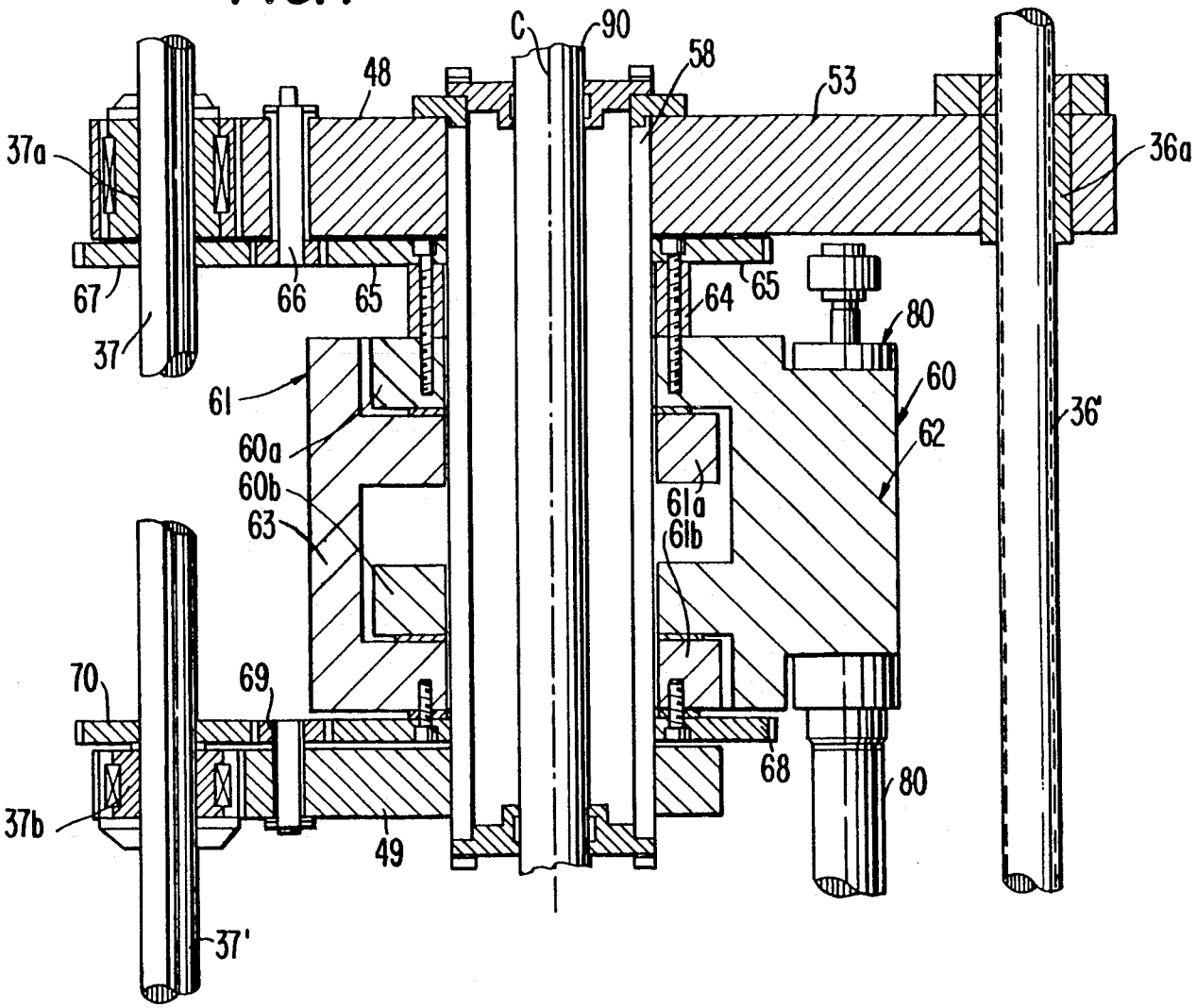
FIG. 7 is a section view of the sliding carriage taken along the line VII—VII of FIG. 5 and FIG. 6.

In the frame 31 of the device 30 a carriage, generally designated with 50, can slide, which carriage includes an upper plate 48 and a lower plate 49 (see FIG. 5 and 6).

The upper plate 48 of carriage 50 has a pair of diametrically opposed arms 51,52. Arm 51 is intended to slidably receive through a bushing 51*a* the guide bar 35 for the vertical movement of the carriage, whereas the other guide bar 35, which is diametrically opposed to the bar 35 slides in a bushing 52*a* placed in the arm 52. In the bushing 37*a* in the arm 52 is also slidably received also the fluted shaft 37. Another pair of diametrically opposed arms 53,54 arranged at 90° with respect to the arms 51,52 rotatably receive the screws 36', 36 by means of lead nuts 36*a*, 36*b* (36*b* not being shown). At the center of the upper plate 48 a bore 57 is provided, which is intended to receive a guide sleeve 58 (FIG. 7) which is connected to the plates 48 and 49.

The lower plate 49 of carriage 50 is provided with two diametrically opposed arms 55.56. Arm 55 slidably receives through a bushing 55*a* the guide bar 35, whereas the arm 56 slidably receives through a bearing 37*b*, through a bushing (not shown), the guide bar 35' and to rotatably receives the fluted shaft 37. The lower plate 49 has a center bore 59 adapted to receive, as already said, the guide sleeve 58.

In the carriage 50 a mechanism permitting the swinging of the gripping means about the central axis C of the carriage is arranged. This mechanism comprises a pair of forked members 60,61 the fork arms of which 60*a*, 60*b* and 61*a*,61*b*, respectively, are provided with aligned bores for rotatably receiving the fixed guide sleeve 58. The fork arm 60*a* is arranged directly above the fork arm 61*a* and the fork arm 60*b* is arranged directly above the fork arm 61*b*. The cross member 62 and 63, respectively of the forked members 60 and 61, respectively is solid and the relevant gripping arm 80 of the device 30 according to the invention is bolted thereto through a bore. Fixed to the fork arm 60*a* by means of screws and through a spacer 64, is a ring gear 65 which is in mesh with a pinion 66, in turn in mesh with a gear 67 keyed in the fluted shaft 37, so that, by rotating the fluted shaft 37, this, through the pinion 66, will rotate the ring gear 65 and therewith, through the spacer 64, the forked member 60. Likewise' fixed to the fork arm 61*b* is a ring gear 68 which is in mesh with a pinion 69 in turn in mesh with a gear 70 keyed in the fluted shaft 37 so that, by rotating the fluted shaft 37 this, through the pinion 69, will rotate the ring gear 68 and therewith the forked member 61. By means of this system the gripping arms 80 of the device 30 can be swung independently from each other by the motors 46,47 along the arc F in the two positions designated with B and D in FIG. 4 and 5.

Figure 4:
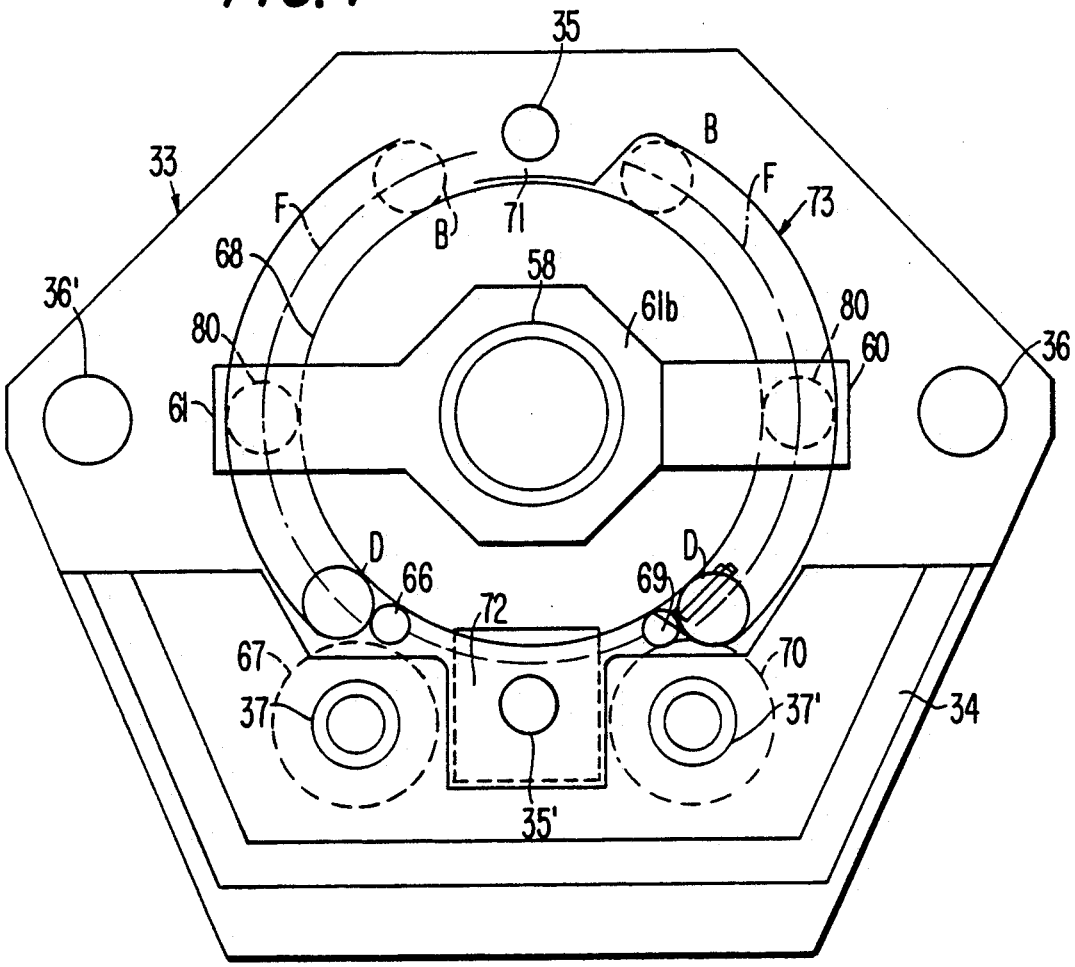
FIG. 4 is a bottom plan view of the lower plate of the device of the present invention.

As can be seen in FIG. 4, both positions of swinging movement of gripping arms 80 are defined by stop means formed of projections 71,72 provided in the opening 73 of the lower frame plate 33, which opening is intended to permit the passage of the gripping arms 80 of device 30 during their movement outwardly and inwardly of the device.

Figure 8:
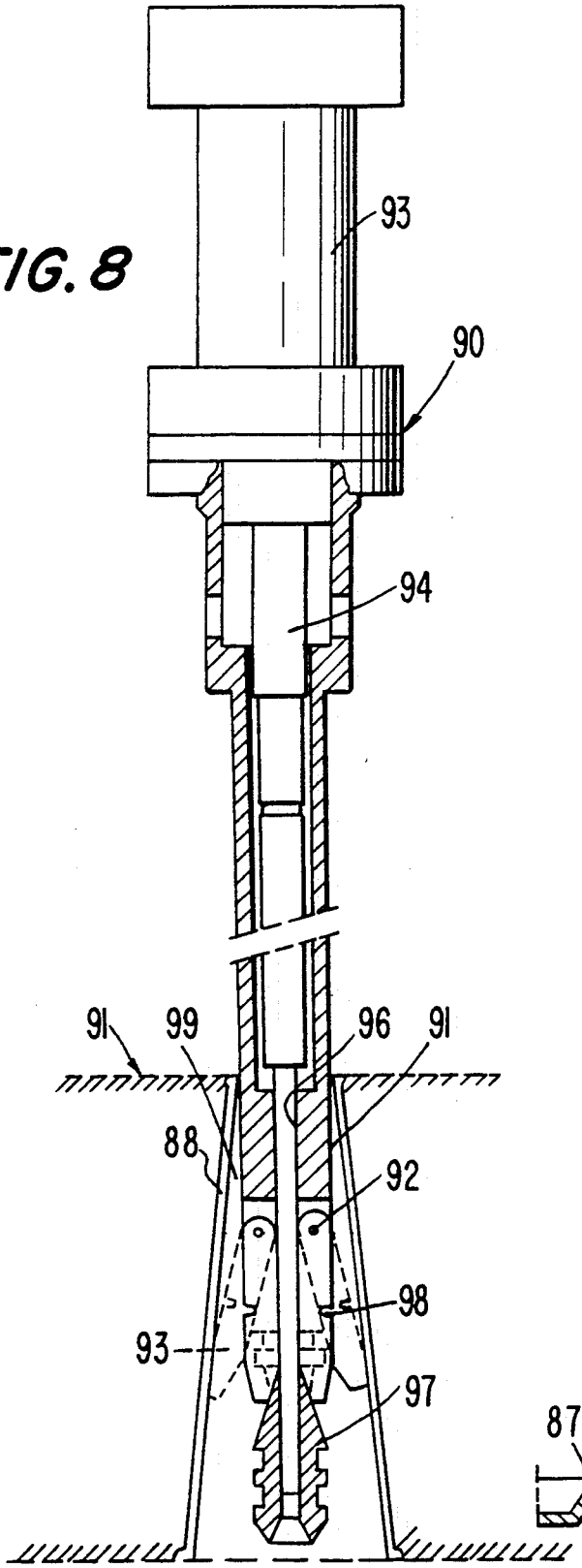
FIG. 8 is a longitudinal section view of the center guide rod provided with means for locking the cheeses in position.

Referring now to FIG. 8, there is shown a guide rod 90 fixed to the upper plate 32 of device 30. This guide rod 90 is hollow and has in its lower end a portion 91 in which a pair of diametrically opposed slits 92 are provided in which a pair of gripping fingers 93 are pivotally connected. Within the hollow guide rod 90 is slidably arranged a piston rod 94 of a pneumatic cylinder 95 which extends through the portion 91 of the guide rod in a bore 96, then through the pair of fingers 93 to the exterior. Fastened to the lower end of the piston rod 94 is a conic element 97 which serves to spread the fingers 93 when the piston rod is retracted. The return in position of the fingers 93, when the piston rod 94 is returned in the start position, is caused by springs 98.

The purpose of this guide rod is to receive the cheeses through their center conic bore, designated with 99 in FIG. 8 and therefore to retain the cheeses of the columns stacked during their lifting movement caused by the gripping arms 80 of device 30. This center guide rod 90 is intended to be brought in alignment with a column 22 on which the cheese stack is to be charged or from which the cheese stack is to be discharged In this manner, the cheese stacks are retained in position and therefore cannot fall down during these operations.

Figure 9:
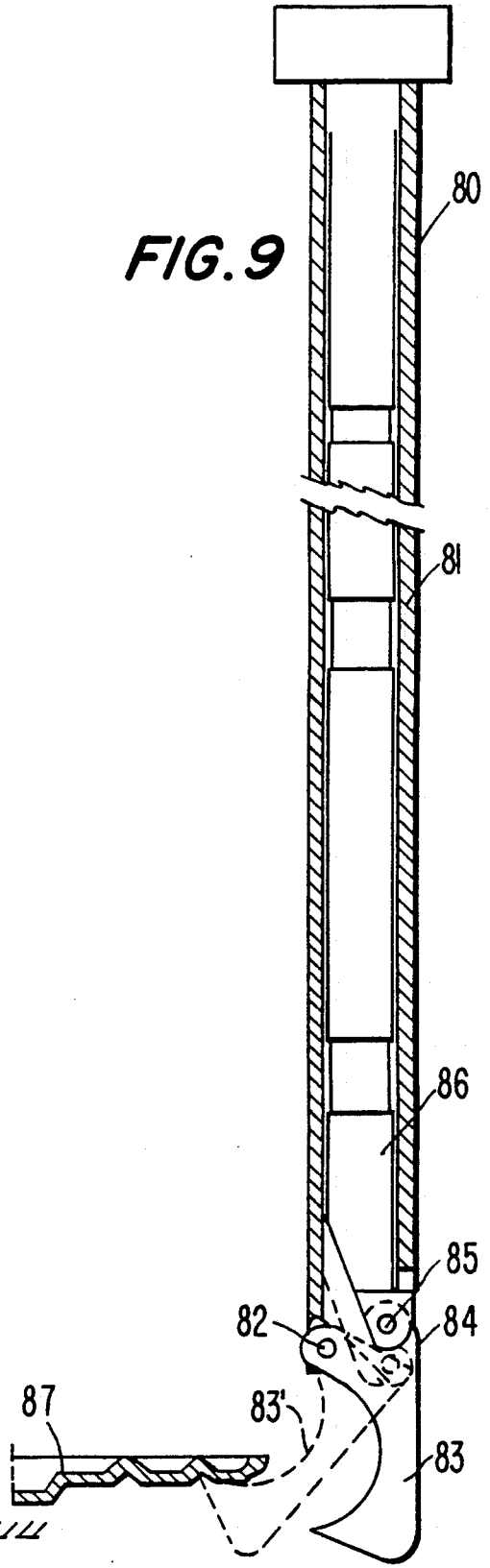
FIG. 9 is a longitudinal section view of a sliding arm provided with gripping means for the cheeses.

FIG. 9 illustrates a gripping arm 80 which comprises a hollow rod 81 at the lower end of which a gripping finger 83 is pivotally connected at 82, the gripping finger being arcuate in shape and having a back projection 84 in which the lower end of a piston rod 86 is pivotally connected at 85, which is slidably arranged within the gripping arm 80 and also moved by a pneumatic cylinder, not shown. In this manner, when the piston rod is moved downwardly, the finger 83 is rotated in a clockwise direction in FIG. 9 to the position 83', shown in dotted line, below a cheese or a support plate 87.

The operation of the device is as follows.

When the device is fastened to the arm 14 of the charging and discharging system shown in FIG. 1 and 2, and the cheese frame is filled with cheeses as shown in the drawings, in order to pick-up the already dyed cheeses from the cheese frame and to transport them to a next treatment station, the device is brought above one of the columns 22 of the cheese frame 20 and is lowered until the guide rod 90 thereof is nearly in contact with the upper end of that column.

At this time, the electric motors 46, 47 will be energized which rotate the fluted shafts 37,37' which, through the gears 67,70, the pinions 66,69 and the ring gears 65,68 will rotate the forked members 60,61, so as to swing the gripping arms 80 in the position in which each of them is perpendicular to one of the void spaces existing about the associated cheese stacks.

Once the device is in this position the motor 38 is started, which, through the belt drives 39,40,41,42,43,44 and 45, will rotate the fluted shafts 36,36', thereby causing the lowering of the carriage 50. With the lowering of the carriage 50 the gripping arms 80 lower also, and enter the void spaces between the cheese stacks and, when they have reached the bottom of the column 22 under control of the associated pneumatic cylinder, will cause the associated piston rod 86 to move outwardly the fingers 83 which will locate below the cheese stacks, has shown in FIG. 9.

At this time the carriage 50 is moved upwardly through the motor 38 and the above-mentioned belt drives so as to bring the cheese stack into a position in which it is threaded on the center guide rod 90. When the last cheese of the stack has been threaded on the guide rod 90, the pneumatic cylinder 95 will be actuated so that the associated piston rod 96 will be retracted within the guide rod 90. In this manner the conic element 97, during its upwardly movement, will open the gripping fingers 93 which will be forced against the inner wall 88 of the cheese bore 99, thereby supporting all the cheese stack. At this time the pneumatic cylinder associated with the gripping arms 80 is actuated so as to return the gripping fingers 83 to the initial position, thereby releasing the cheese stack from the gripping arms 80.

The device is now moved, by means of the horizontal arm 14, above the conveyor belt 25 and lowered on the guide columns 11 to such a position as to lay down the cheeses of the stack on the conveyor belt one at the time. This operation is carried out by closing the gripping fingers 93 of the center guide rod 90 so that the lowermost cheese will fall down by gravity and then by again opening the fingers 93 so as to lock the next cheese until the conveyor belt has transported away the already laid down cheese. In this manner, all the cheeses of the stack will be laid down one at a time on the conveyor belt 25. In order to charge the cheeses to be dyed on the cheese frame, it will be sufficient to proceed in the reverse sequence, that is, lowering of the gripping arms on the cheese 21 transported by the conveyor belt 25, gripping of this cheese 21 it from the underside by means of the fingers 83 of arms 80 and then rising of the carriage 50 until the cheese is threaded on the center guide rod 90. Then, through the fingers 93 of the center guide rod, the cheese will be locked thereon and the gripping arms 80 can be again lowered for picking up a next cheese and threading it on the guide arm 90. This operation will be repeated until the desired cheese stack is formed, which will be brought in alignment with the column 22 on which it is to be placed by moving the device 30 above the cheese frame 20 with simultaneously rotation thereof for bringing the associated column below the device 30. Thereafter, the cheeses of the stack can be placed on the associated column one at the time, always through the gripping arms 80, or else the cheese stack can be caused to fall down as a whole by closing the fingers 93 of the guide rod 90.

Of course, all the movements of the above described elements, i.e. the device 30, the cheese frame 20, the gripping arms 80, the gripping fingers 83 thereof, the gripping fingers 93 of the guide rod 90 are syncronized by a central computerized control unit. In particular, the swinging of the gripping arms 80 to bring them accurately on the void spaces between the cheese stacks can be carried out, for example, by a television camera located above the cheese frame and associated to the computerized control unit or by means of a program predetermined by the operator and memorized in the control unit.

However, since these details forms no part of the present invention, they are not described because computerized units already known in the field and already used for controlling these movements can be employed.

Although the present invention has been described and illustrated merely in connection with a preferred embodiment thereof, it is apparent that variations and modifications at the reach of those skilled in the art, can be made thereto without departing from the scope of the invention.

In particular, the column supporting the carriage of the vertical movement of the device can be provided also with means for its swinging movement, in which case a rotatable platform for supporting the cheese frame cannot be needed.

What is claimed is:

1. An apparatus for loading and unloading articles, comprising:

a frame;

a locking rod freely extending from said frame, said locking rod having a longitudinal axis and a free end;

means for expanding the diameter of said free end of said locking rod to engage an article;

a carriage mounted to said frame for movement substantially parallel to said axis;

means for moving said carriage with respect to said frame in directions substantially parallel to said axis;

a plurality of gripping arms connected to said carriage, said gripping arms extending from said carriage substantially parallel to said axis, said gripping arms being mounted on said carriage radially of, and for rotation about, said axis;

gripping means mounted at the free end of each of said arms for gripping the article; and means for rotating each of said arms independently about said axis.

2. An apparatus as in claim 1, wherein said carriage further comprises a sleeve aligned substantially coaxially about said locking rod, and each of said gripping arms includes at least one element mounted on said sleeve for rotation thereabout.

3. An apparatus as in claim 2, wherein said frame includes first and second spaced substantially parallel plates and means fixing the relative position of said plates, said second plate including an aperture extending therethrough, and wherein said locking rod extends from said first plate through said aperture, and said gripping arms extend through said aperture.

4. An apparatus as in claim 3, wherein said frame includes a plurality of guide bars extending between and fixed to said plates, each of said guide bars extending substantially parallel to said longitudinal axis, and said carriage slidingly engages said guide bars.

5. An apparatus as in claim 4, wherein said means for moving said carriage comprises a pair of threaded shafts extending between and rotatably connected to said plates, said shafts extending substantially parallel to said longitudinal axis, said carriage threadedly engaging said shafts, and further comprises means for simultaneously rotating said shafts.

6. An apparatus as in claim 5, wherein said means for rotating said arms includes a number of fluted shafts, equal to the number of arms, extending between and rotatably connected to said plates, said fluted shafts extending substantially parallel to said longitudinal axis.

7. An apparatus as in claim 6, wherein said means for rotating said arms further includes a number of gears, equal to the number of arms, rotatably mounted on said carriage and each engaged with a respective one of said fluted shafts, a gear fixed to one said element of each of said arms,, a number of pinions, equal to the number of arms, each engaged between a respective one of said gears fixed to said arms and said gears mounted on said carriage.

8. An apparatus as in claim 7, wherein each of said gripping means comprises a gripping finger mounted on the free end of an associated one of said arms for rotation about a gripping axis perpendicular to said longitudinal axis, and also comprises means for rotating said finger about said gripping axis.

9. An apparatus as in claim 8, wherein said means for expanding the diameter of the free end of said locking rod comprises a plurality of locking fingers each mounted to the free end of said locking rod for rotation about a respective locking axis perpendicular to said longitudinal axis, and also comprises means for rotating said locking fingers about said respective locking axes.

10. An apparatus as in claim 9, further comprising a base, said frame being mounted to said base for movement substantially parallel to said longitudinal axis and for movement substantially perpendicular to said longitudinal axis, and further comprising means for moving said frame substantially parallel to said longitudinal axis and means for moving said frame substantially perpendicular to said longitudinal axis.

* * * * *